US007515848B2

(12) United States Patent
Kitozaki

(10) Patent No.: US 7,515,848 B2
(45) Date of Patent: Apr. 7, 2009

(54) IMAGE FORMING APPARATUS IN WHICH AN IMAGE FORMING UNIT IS MOUNTED AND DISMOUNTED BY ROTATING AN INTERMEDIARY TRANSFER MEMBER

(75) Inventor: Yukihiro Kitozaki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 96 days.

(21) Appl. No.: 11/470,136

(22) Filed: Sep. 5, 2006

(65) Prior Publication Data

US 2007/0059033 A1 Mar. 15, 2007

(30) Foreign Application Priority Data

Sep. 9, 2005 (JP) ..... 2005-261521

(51) Int. Cl.
*G03G 15/00* (2006.01)
*G03G 21/18* (2006.01)
*G03G 15/08* (2006.01)

(52) U.S. Cl. ..... 399/110; 399/113; 399/121

(58) Field of Classification Search ..... 399/110, 399/113, 116, 121, 111, 117
See application file for complete search history.

(56) References Cited

U.S. PATENT DOCUMENTS

| | | | | |
|---|---|---|---|---|
| 6,801,742 | B1 | 10/2004 | Mochimaru et al. | |
| 6,996,354 | B2 * | 2/2006 | Kimura et al. | 399/121 |
| 7,020,415 | B2 * | 3/2006 | Abe | 399/110 |
| 7,212,767 | B2 * | 5/2007 | Hosokawa et al. | 399/111 |

FOREIGN PATENT DOCUMENTS

| | | |
|---|---|---|
| EP | 1 331 524 A2 | 7/2003 |
| EP | 1 347 344 A2 | 9/2003 |
| EP | 1 429 199 A2 | 6/2004 |
| JP | 60-131558 | 7/1985 |
| JP | 60-131558 A | 7/1985 |
| JP | 11-38711 | 2/1999 |
| JP | 11-308711 A | 2/1999 |

(Continued)

OTHER PUBLICATIONS

Russian Office Action dated Dec. 3, 2007, issued in appln. No. 2006132433/28(035267).

(Continued)

*Primary Examiner*—Sandra L Brase
(74) *Attorney, Agent, or Firm*—Fitzpatrick, Cella, Harper & Scinto

(57) ABSTRACT

An image forming apparatus has an image forming unit including an image bearing member, an intermediary transfer member onto which an image formed on the image bearing member is transferred, the intermediary transfer member being located at an upper portion of the image forming unit, a housing for supporting and accommodating the image forming unit and the intermediary transfer member, the housing being drawable from the image forming apparatus with the image forming unit and the intermediary transfer member supported thereby, a supporting portion for supporting the intermediary transfer member for rotation relative to the housing, and a mounting and demounting portion, provided in the housing, for permitting the image forming unit to be mounted and demounted relative thereto. The mounting and dismounting of the image forming unit is enabled by rotating the intermediary transfer member, after the housing is pulled out of the image forming apparatus.

15 Claims, 14 Drawing Sheets

FOREIGN PATENT DOCUMENTS

| | | |
|---|---|---|
| JP | 2002-182539 | 6/2002 |
| JP | 2003-287939 | 10/2003 |
| JP | 2004-109455 | 4/2004 |
| JP | 2004-109455 A | 4/2004 |
| JP | 2005-141277 | 6/2005 |

OTHER PUBLICATIONS

Russian Official Action dated Aug. 20, 2008, issued in corresponding Russian patent application No. 2006132433/28(035267), with English translation.

* cited by examiner

IMAGE FORMING APPARATUS IN WHICH AN IMAGE FORMING UNIT IS MOUNTED AND DISMOUNTED BY ROTATING AN INTERMEDIARY TRANSFER MEMBER

This application claims priority from Japanese Patent Application No. 2005-261521, filed Sep. 9, 2005, which is hereby incorporated by reference herein.

FIELD OF THE INVENTION AND RELATED ART

The present invention relates to an image forming apparatus, such as a copying machine, a printer, etc., for forming an image with the use of an electrophotographic method.

In the field of image forming apparatus employing an electrophotographic image forming method, color image forming apparatuses, more specifically, color image forming apparatuses employing multiple image formation stations for forming a color image on a recording medium, have been put to practical use. In these color image forming apparatuses, each image formation station has a photosensitive drum, and processing means, which act on the photosensitive drum. For the size reduction of these apparatuses, and also, for preventing variations in recording media from resulting in the formation of unsatisfactory images, various structures have been devised. In particular, a structural arrangement, in which multiple images formed on photosensitive drums in multiple image formation stations, one for one, are transferred (primary transfer) in layers onto an intermediary transfer belt, and then, the images on the intermediary transfer belt are transferred (secondary transfer) all at once onto a recording medium, has been widely used.

Among the color image forming apparatuses, such as those described above, there are color image forming apparatuses in which, in order to reduce the distance by which an image formed on the intermediary transfer belt by the primary transfer moves to reach the second transfer station, an intermediary transfer belt is disposed on the top side of the juxtaposed multiple image formation stations. As examples of the technologies for replacing a photosensitive drum and the structured components disposed around the photosensitive drum in these color image forming apparatuses, there are the technologies disclosed in Japanese Laid-Open Patent Applications No. 2005-141277, and No. 2003-287939. The structure disclosed in Japanese Laid-Open Patent Application No. 2005-141277 is such that an intermediary transfer belt and multiple image bearing members are enabled to be separately pulled out of the main assembly of the image forming apparatus. According to the technology disclosed in Japanese Laid-Open Patent Application No. 2003-287939, multiple image bearing members, an intermediary transfer belt, and the structural components, disposed in the adjacencies of the image bearing members and intermediary transfer belt, are enabled to be pulled out frontward of the housing of the main assembly. There are also such structural arrangements in which the above-mentioned multiple image bearing members, intermediary transfer belt, and the structural components disposed around them, are integrally supported by a supporting plate, which can be pulled out frontward of the housing of the main assembly along with the components supported thereon. One of such structural arrangements is also discussed in Japanese Laid-Open Patent Application No. 2002-182539.

As described above, according to Japanese Laid-Open Patent Application No. 2003-287939, it is possible that the photosensitive member, intermediary transfer belt, and the various other members (which, hereinafter, will be referred to as members involved in image formation) are integrally supported by a supporting plate, which is enabled to be pulled out along with the components supported thereon. In the case of this structural arrangement, the intermediary transfer belt is disposed above the photosensitive drums. Therefore, this arrangement suffers from the problem that it requires a greater number of operational steps when replacing the photosensitive drums, although the severity of this problem depends on the structural arrangement for disengaging the intermediary transfer member from its support. It also suffers from the problem that the intermediary transfer member interferes with the removal of the photosensitive drums.

SUMMARY OF THE INVENTION

The primary object of the present invention is to improve an image forming apparatus in terms of the operability regarding the operation carried out by a user to replace the process units, such as a photosensitive drum involved in image formation, while ensuring the accuracy in the positional relationship between the multiple photosensitive drums and the intermediary transfer member.

According to an aspect of the present invention, there is provided an image forming apparatus comprising an image forming unit including an image bearing member, an intermediary transfer member onto which an image formed on the image bearing member is transferred, the intermediary transfer member being disposed at an upper portion of the image forming unit, a first housing for supporting and accommodating the image forming unit and the intermediary transfer member, the first housing being drawable with the image forming unit and the intermediary transfer member supported thereby, and a mounting and demounting portion, provided in the first housing, for permitting the image forming unit to be mounted and demounted relative thereto by a change in a relative position between the intermediary transfer member and the image forming unit.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be described with reference to the preferred embodiments of the present invention.

Next, the preferable embodiments of the present invention will be concretely described in detail with reference to the appended drawings. Incidentally, if a given component in one of the drawings has the same referential symbol as the one which a given component in another drawing has, the two components are the same in structure and functions. Thus, identical components will be described only once to avoid repetition of the same description.

Figure 1:
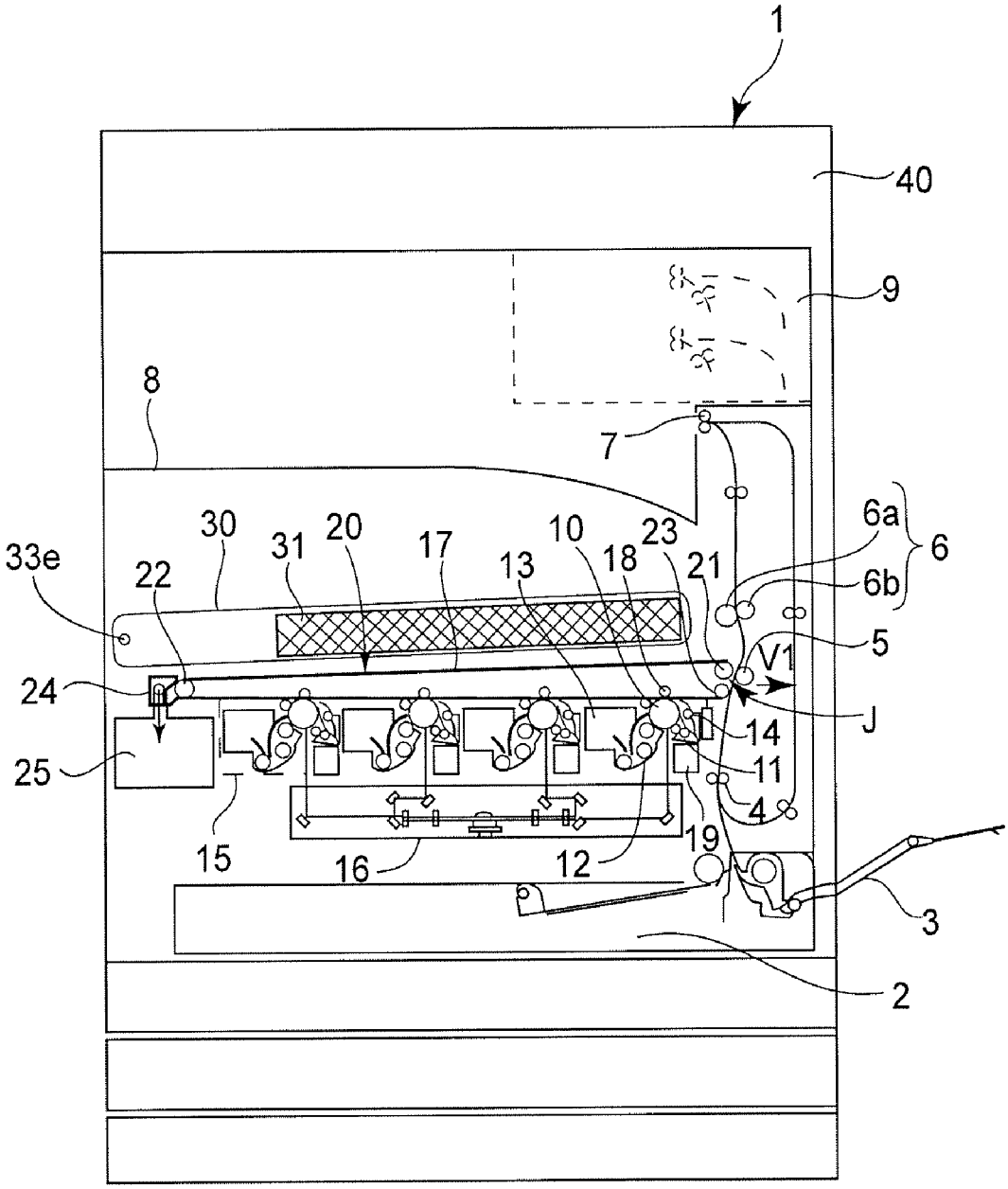
FIG. 1 is a sectional view of the image forming apparatus in one of the preferred embodiments of the present invention.

First, referring to FIG. 1, the basic structure of a typical image forming apparatus will be described. The image forming apparatus shown in FIG. 1 is a color image forming apparatus of the so-called inline type. In this image forming apparatus, therefore, multiple photosensitive drums 10, as image bearing members, are horizontally aligned in parallel, and a color image is formed by sequentially placing, in layers, the multiple toner images, different in color, formed on the photosensitive drums, onto an intermediary transfer belt 17.

The image forming apparatus 1 is provided with four process cartridges 15 as image formation units, which are roughly horizontally aligned with preset intervals. The four cartridges 15 form yellow, magenta, cyan, and black toner images, one for one.

In each process cartridge 15, an electrophotographic photosensitive member 10 as an image bearing member, which is in the form of a drum (which, hereinafter, will be referred to simply as a photosensitive drum), is disposed. Around the peripheral surface of the photosensitive drum 10, a primary charger 11, a developing apparatus 12, a toner storage portion 13, and a drum cleaning apparatus 14, which act on the photosensitive drum 10, are disposed. Below the gap between the primary charger 11 and developing apparatus 12, an exposing apparatus 16 for exposing the photosensitive drum 10 is disposed. Further, in an area which opposes the photosensitive drum 10, a primary transfer roller 18, as a transferring means, is disposed, with the intermediary transfer belt 17 interposed between the photosensitive drum 10 and the primary transfer roller 18.

To the four developing apparatuses 12, yellow toner, cyan toner, magenta toner, and black toner are supplied from the corresponding toner storage portions 13.

Each photosensitive drum 10 is a photosensitive member made up of a negatively chargeable organic photoconductor. More specifically, it is made up of an aluminum drum as a substrate, and an organic photoconductive layer formed on the peripheral surface of the substrate. It is rotationally driven at a preset process speed by a driving apparatus (not shown).

The primary charger 11, as the primary charging means, uniformly charges the surface of the photosensitive drum 10 to a present negative potential level by the charge bias applied from a charge bias power source (not shown).

The developing apparatus 12 contains toner as developer, and develops an electrostatic latent image formed on the corresponding photosensitive drum 10, into a toner image (visible image) by adhering toner to the electrostatic latent image.

The primary transfer roller 18, as the primary transferring means, is disposed within an intermediary transfer belt unit 20, being kept pressed toward the photosensitive drum 10.

The drum cleaning apparatus 14 has a cleaning blade, or the like, for removing the toner remaining on the photosensitive drum 10 after the primary transfer, from the photosensitive drum 10. The recovered waste toner is recovered into a waste toner storage portion 19. Incidentally, there are image forming apparatuses in which the waste toner on the photosensitive drums 10 is transferred onto the intermediary transfer belt 17, instead of being recovered into the process cartridge 15 by the drum cleaning apparatus 14.

The intermediary transfer belt unit 20 is provided with a driver roller 21, a follower roller 22, and a tension roller 23, around which the intermediary transfer belt 17, as the intermediary transfer member, is stretched. The shaft of the driver roller 21 is fitted with a gear (not shown), through which a driving force is transmitted from a driver gear on the main assembly side of the apparatus, to rotationally drive the driver roller 21. As this gear is rotationally driven, the intermediary transfer belt 17 circularly moves. The driver roller 21 is positioned so that it opposes a secondary transfer roller 5, doubling as the roller which opposes the secondary transfer roller 5.

Figure 11:
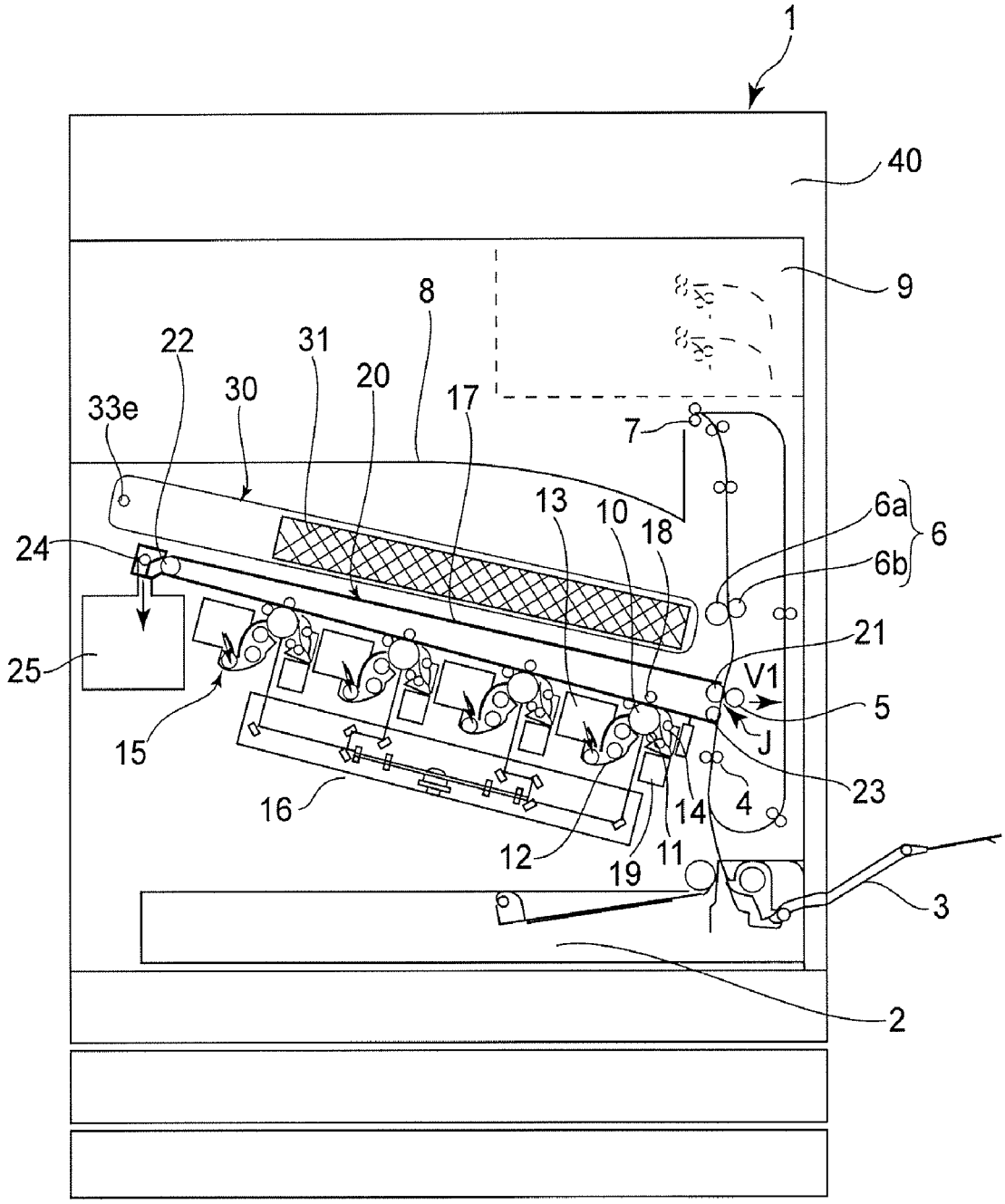
FIG. 11 is a sectional view of another example of an image forming apparatus.
Figure 12A:
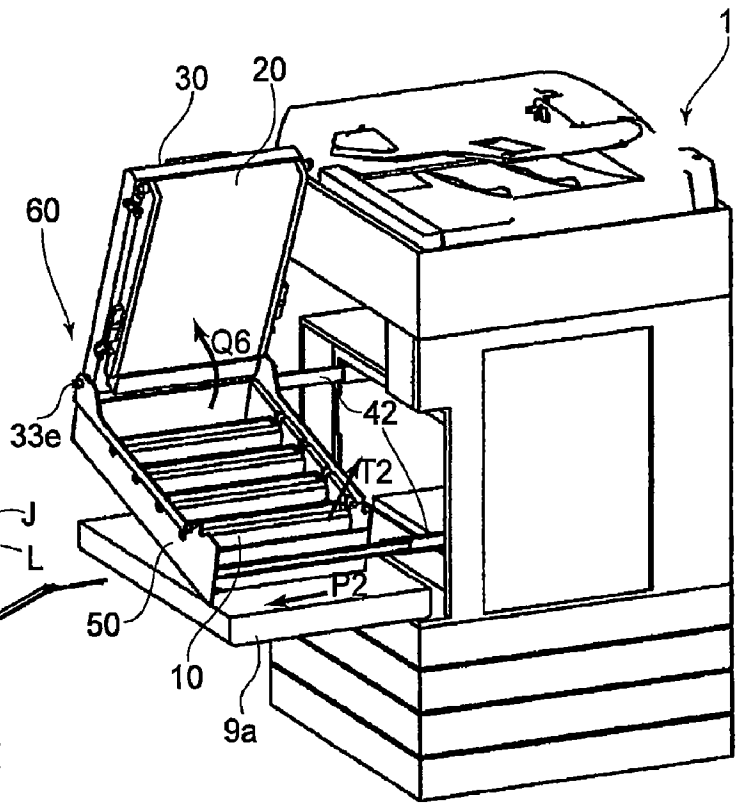
FIGS. 12(*a*) and 12(*b*) are drawings showing the method for replacing the process cartridges.
Figure 12B:
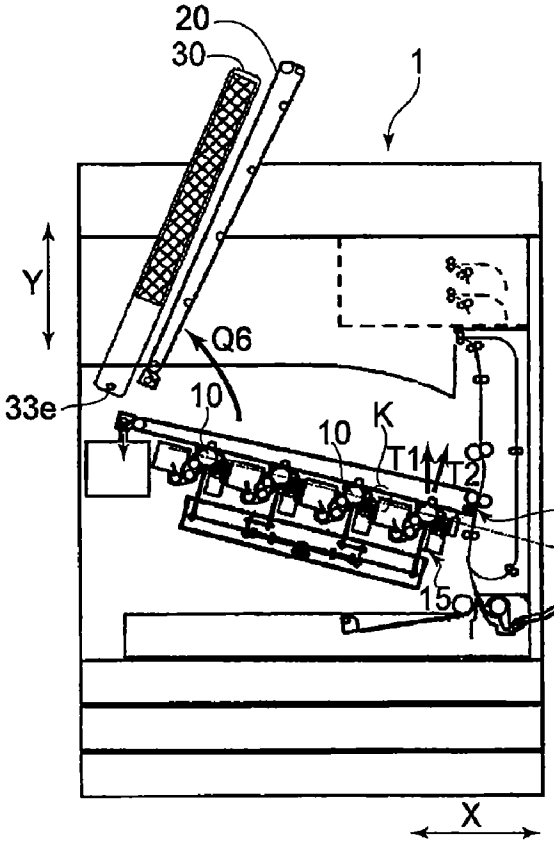

The intermediary transfer belt unit 20 is held by a transfer frame 30, in which a high voltage transfer power source 31 (high voltage transferring means) is disposed. The transfer frame is pivotable about point 33*e*, as shown in FIGS. 1, 11 12(*b*) and 14(*b*). The high voltage transfer power source 31 is provided for supplying a high voltage for transferring the image formed on the photosensitive drum 10 onto the intermediary transfer belt 17.

On the downstream side of the secondary transfer roller 5, in terms of the recording medium conveyance direction, a fixing apparatus 6, having a fixation roller 6*a* and a pressure roller 6*b*, is disposed. The fixing apparatus 6 is structured so that a recording medium is vertically passed through the fixing apparatus 6.

The exposing apparatus 16 is made up of a laser-based light emitting means, which emits a beam of light in response to sequential picture element signals, in the form of electrical digital signals, which reflects the provided image information. The exposing apparatus 16 forms an electrostatic latent image, according to the image information, on the surface of each of the photosensitive drums 10, having been charged by the primary chargers 11, one for one. The four electrostatic latent images formed on the four photosensitive drums 10, one for one, are different in color. The exposing apparatus 16 is disposed below the process cartridges 15, and is fixedly disposed in the image forming apparatus 1.

Next, the image forming operation of the above-mentioned image forming apparatus will be described.

An original is read by an original reading apparatus 40. As an image formation start signal is issued, the photosensitive drum 10 of each process cartridge 15, which is rotationally driven at a preset process speed, is uniformly charged to the negative polarity by the corresponding primary charger 11. The exposure apparatus 16 projects, from its laser-based light emitting elements, a beam of laser light, while modulating it with the video signals inputted into the exposing apparatus 16 from outside of the exposing apparatus. The video signals reflect the color components into which the optical image of the original has been separated. As a result, four electrostatic latent images are formed on the four photosensitive drums 10, one for one.

Next, the electrostatic latent image formed on each photosensitive drum 10 is developed into a visible image (toner image) by the corresponding developing apparatus 12. More specifically, the toner of a specific color assigned to each developing apparatus 16 is adhered to the electrostatic latent image on the corresponding photosensitive drum 10, by the developing apparatus 12 to which a development bias is being applied. The development bias is the same in polarity as the polarity (negative) to which the photosensitive drum 10 has been charged. Each toner image is transferred (primary transfer) onto the intermediary transfer belt 17 by the primary transfer roller 18. More specifically, while the intermediary transfer belt 17 is driven, the primary transfer bias (which is opposite in polarity to photosensitive drum 10 and toner, and therefore, positive) is applied to the primary transfer roller 18. As a result, the toner image is transferred (primary transfer) onto the intermediary transfer belt 17.

The four toner images formed on the four photosensitive drums 10, one for one, are similarly transferred onto the intermediary transfer belt 17 by the intermediary transfer belt unit 20; the yellow, magenta, cyan, and black toner images are sequentially transferred in layers onto the intermediary transfer belt 17, effecting a full-color toner image on the intermediary transfer belt 17.

The transfer residual toner, or the toner remaining on each photosensitive drum 10 after the primary transfer, is scraped down by a cleaner blade, or the like, with which the drum cleaning apparatus 14 is provided, and then, is recovered.

The leading edge of the full-color toner image on the intermediary transfer belt 17 of the intermediary transfer belt unit 20 is moved to the secondary transfer station, which is between the driver roller 21 (which opposes secondary transfer roller 5) and secondary transfer roller 5. Meanwhile, each sheet of a recording medium conveyed from a feeding-and-conveying cassette 2 or a manual feeding tray 3 is conveyed through the vertical path, and then, is conveyed to the secondary transfer station by a pair of registration rollers 4, in synchronism with the timing with which the above-mentioned leading edge of the toner image is moved to the secondary transfer station. The toner images effecting the full-color toner images are transferred (secondary transfer) all at once by the secondary transfer roller 5, to which the second transfer bias (which is opposite in polarity to toner, and therefore, positive) is being applied, onto the recording medium conveyed to the secondary transfer station.

The toner remaining on the intermediary transfer belt 17 after the secondary transfer is scraped down by a transfer cleaning apparatus 24, and then, is conveyed to a waste toner storage container 25.

The recording medium, on which the full-color toner image has just been effected, is conveyed to the fixing apparatus 6 disposed downstream. In the fixing apparatus 6, the full-color toner image is subjected to heat and pressure in the fixation nip formed between the fixation roller 6*a* and pressure roller 6*b*. As a result, the full-color toner image is thermally fixed to the surface of the recording medium. Thereafter, the recording medium is discharged onto a delivery tray 8, which constitutes the top surface of the main assembly, by a first pair of discharge rollers 7. This concludes the image formation sequence.

Incidentally, the image forming apparatus is structured so that additional discharging apparatuses 9 can be placed above the first pair of discharge rollers 7, in the main assembly.

Embodiment 1

Figure 2A:
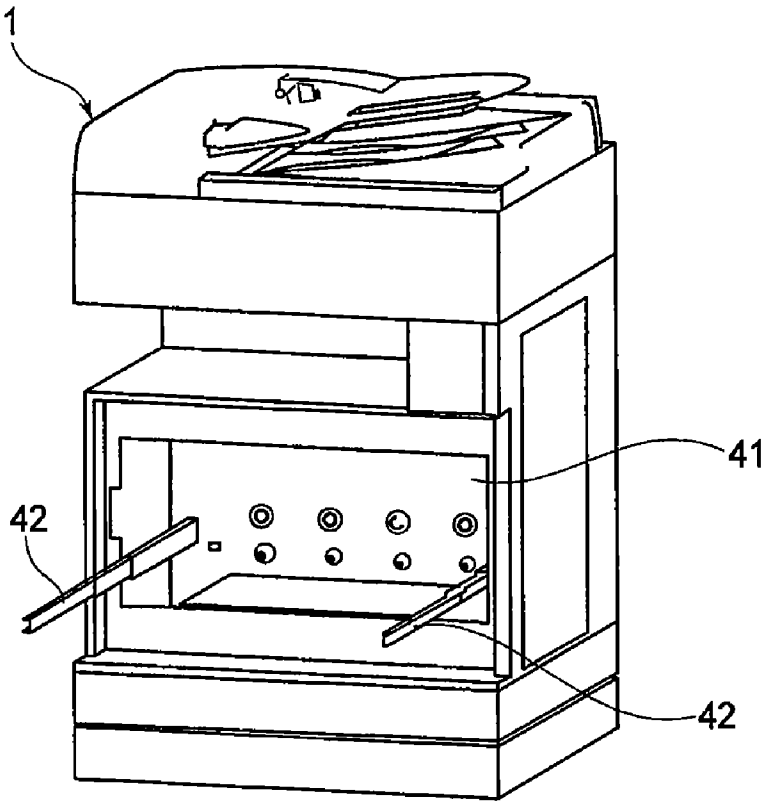
FIGS. 2(*a*) and 2(*b*) are drawings showing the structure of the housing of the image forming apparatus.
Figure 2B:
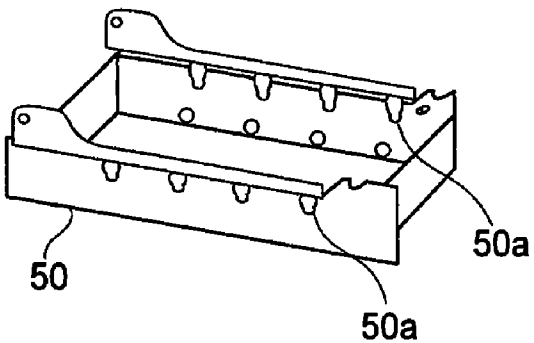

Next, referring to FIGS. 2(*a*) to 3(*b*), the structure of the housing of the image forming apparatus in the first embodiment of the present invention will be described. FIGS. 2(*a*) and 2(*b*) are schematic perspective views of the housing of the image forming apparatus, showing the structure thereof, and FIGS. 3(*a*) and 3(*b*) are perspective views of the housing for the image formation stations of the image forming apparatus, and the process cartridges, showing the positioning of the process cartridges relative to the housing.

First, referring to FIGS. 2(*a*) and 2(*b*), the image forming apparatus 1 is made up of a housing 50 (first housing) for the image formation stations (which, hereafter, will be referred to as image formation station housing 50), which integrally supports the process cartridges 15 and intermediary transfer belt unit 20, and a main housing 41 (second housing), which supports the entirety of the main assembly of the image forming apparatus. The housing 50 is mounted by pins 50*c* and 50*e*. The main housing 41 has a pair (left-hand and right-hand) of support rails 42 (members in the form of rails), which supports the image formation station housing 50, when the image formation station housing 50 is pulled out of the image forming apparatus 1. The support rails 42 can be extended or shrunk. In other words, the image formation station housing 50 can be pulled out of the image forming apparatus 1 or retracted into the image forming apparatus 1, while remaining supported by the pair of support rails 42, with which the main housing 41 is provided.

As described above, the image formation station housing 50 is structured so that it can be pulled out of the image forming apparatus 1, or retracted into the image forming apparatus 1 while integrally supporting the process cartridge 15 and intermediary transfer belt unit 20. Further, the image formation station housing 50 supports the intermediary transfer belt unit 20 so that the intermediary transfer belt 20 (or process cartridges) can be moved to expose the process cartridges 15. In other words, the opening through which the process cartridges 15 can be mounted or removed can be created by moving the intermediary transfer belt unit 20. Next, this arrangement will be described in detail.

Figure 3A:
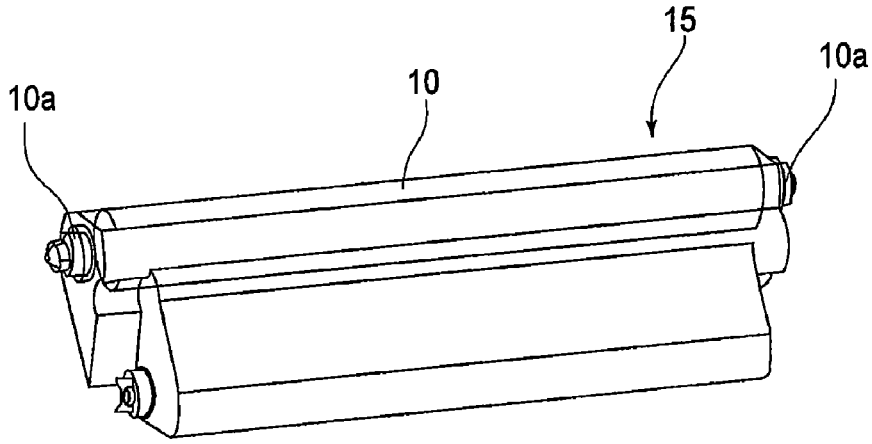
FIGS. 3(*a*) and 3(*b*) are drawings showing the positioning of the process cartridges relative to the housing for the image formation stations.
Figure 3B:
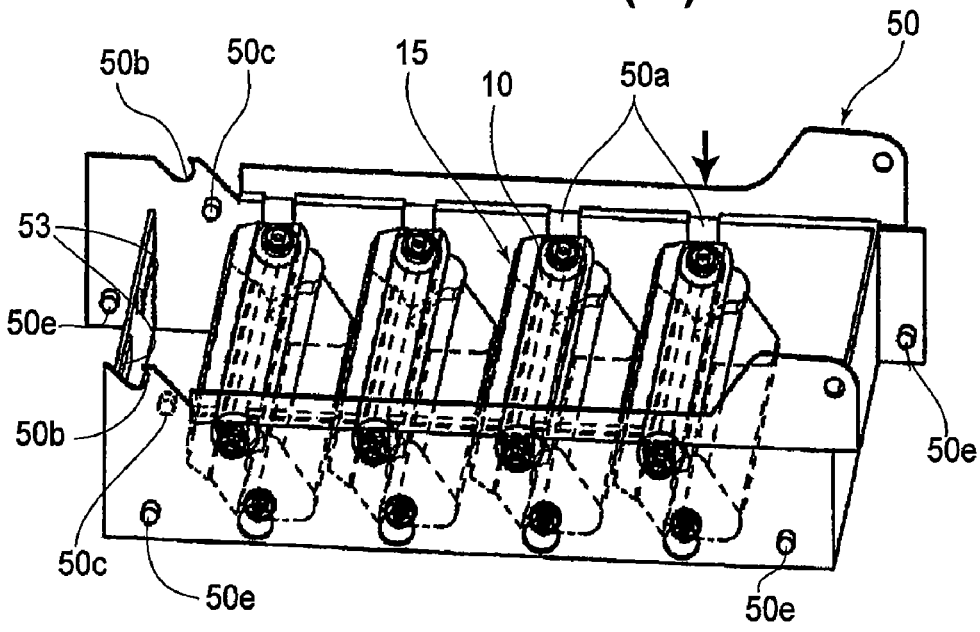

The process cartridges 15 are removably mounted into the image formation station housing 50 by being inserted into the direction indicated by an arrow mark in FIG. 3. The image formation station housing 50 is provided with multiple sets of guiding members for mounting the process cartridges 15, so that the process cartridges 15 are accurately positioned relative to the housing 50, or removing the process cartridges 15 from the housing 50. The image formation station housing 50 is structured so that after each process cartridge is inserted into the image formation station housing 50, the process cartridge 15 is guided by the corresponding set of guiding members, to be mounted into the housing 50, with a pair of bearings 10*a* fitted around the lengthwise ends of each photosensitive drum 10, one for one, supported by the corresponding pair of drum supporting portions 50*a* with which the opposing surfaces of the wall of the housing 50 are provided, one for one.

Further, the image formation station housing 50 also integrally supports a resist-density detecting apparatus 53, which detects the changes in the image density of the image forming apparatus and the level of positional deviation at which the four toner images are transferred onto the intermediary transfer belt 17, by detecting the toner images on the intermediary transfer belt 17. With the employment of the structural arrangement described above, the position of each photosensitive drum 10 is detected at an extremely high level of accuracy, and no detection error occurs. Therefore, the image forming apparatus is stabilized in terms of image density and the image position relative to the intermediary transfer belt 17.

Figure 4A:
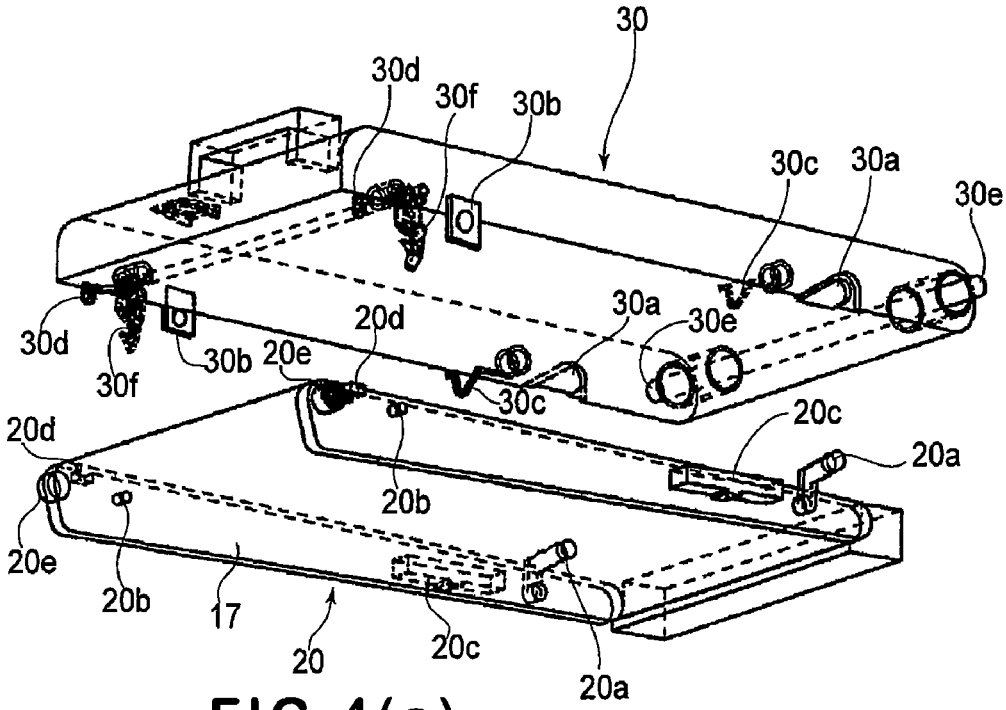
FIGS. 4(*a*) and 4(*b*) are drawings showing the structure of the intermediary transfer belt unit.
Figure 4B:
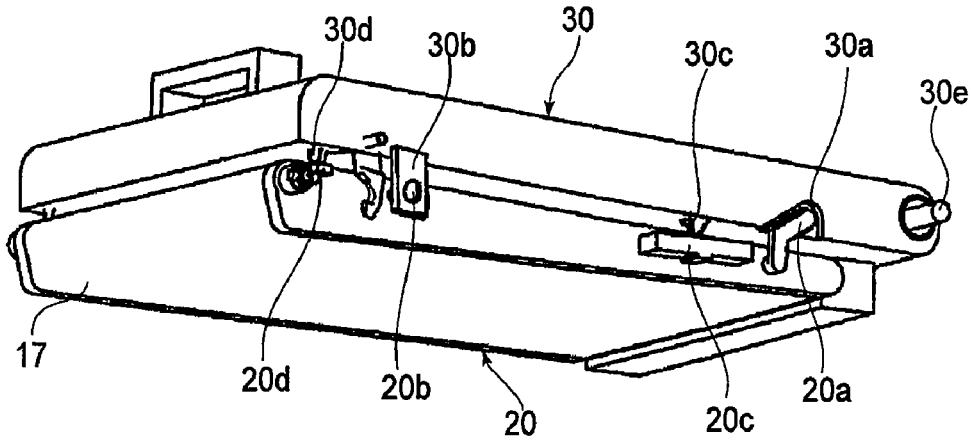

At this time, referring to FIGS. 4(*a*) and 4(*b*), the structure of the adjacencies of the intermediary transfer belt unit 20 will be described. FIGS. 4(*a*) and 4(*b*) are perspective views of the intermediary transfer belt unit 20, showing the structure thereof.

FIG. 4(*a*) shows one of the intermediary transfer belt units 20 and the corresponding transfer frame 30. Each intermediary transfer belt unit 20 and corresponding transfer frame 30 are structured so that a pair of first support shafts 20*a* (which are different in position), with which the intermediary transfer belt unit 20 is provided, are engaged, one for one, with a pair of first holding portions 30*a* (which are different in position), with which the transfer frame 30 is provided. Further, they are structured so that a pair of second support shafts 20*b* (which are different in position) with which the intermediary transfer belt unit 20 is provided, are engaged with a pair of second support portions 30*b* (which are different in position) with which the transfer frame 30 is provided. The pair of second support portions 30*b* are located so that after the joining of the intermediary transfer belt unit 20 and transfer frame 30, they will be near the driver roller 21 used for the second transfer. Next, referring to FIG. 4(*b*), the intermediary transfer belt unit 20 and transfer frame 30 are joined so that the pair of support shafts 20*a* are inserted into the pair of support portions 30*a*, one for one, and the pair of support shafts 20*b* are inserted into the pair of support portions 30*b*, one for one.

During this joining, a pair of first pressure application springs 30*c* located in the transfer frame 30 are attached, in the compressed state, to a pair of first support portions 20*c*, one for one, with which the intermediary transfer belt unit 20 is provided, and a pair of second pressure application springs 30*d* located also in the transfer frame 30 are attached, in the compressed state, to a pair of second support portions 20*d*, one for one, with which the intermediary transfer belt unit 20 is provided. The pair of second support portions 20*d* is located so that they will be located near the driver roller 21 after the joining of the intermediary transfer belt unit 20 and transfer frame 30.

Figure 5A:
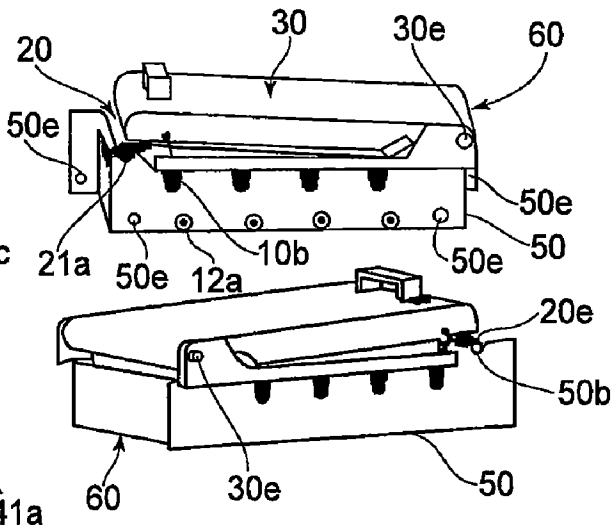
FIGS. 5(*a*) and 5(*b*) are drawings showing the structure of the image formation unit.
Figure 5B:
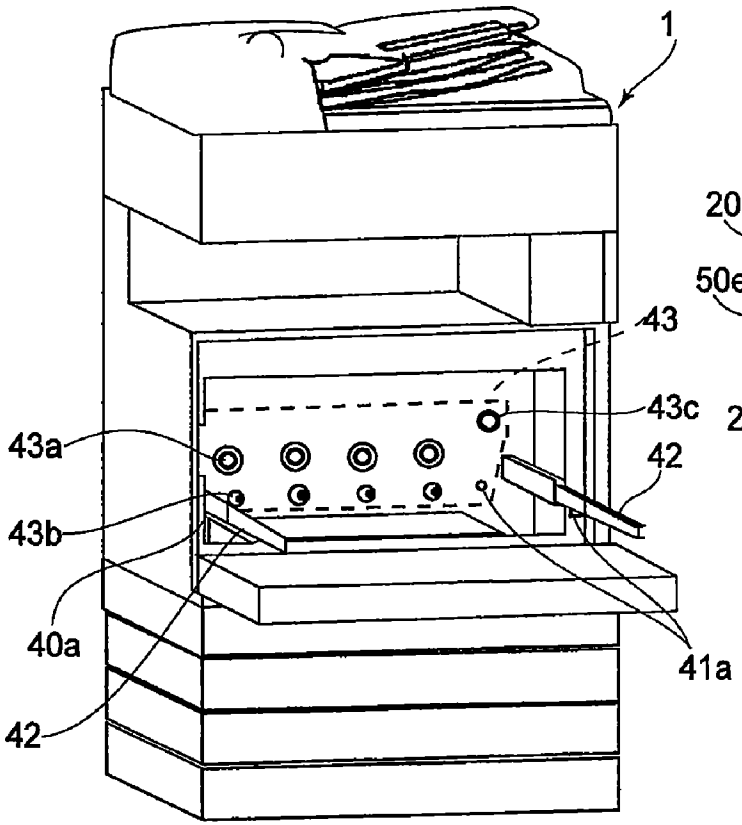

Next, referring to FIGS. 5(*a*) and 5(*b*), the relationship between the intermediary transfer belt unit 20 and the image formation station housing 50, after the joining of the intermediary transfer belt unit 20 and transfer frame 30, will be described. As shown in FIG. 5(*a*), after being joined with each other by locators 12*a*, the intermediary transfer belt unit 20 and transfer frame 30 are supported (at two locations, that is, at widthwise ends) by the image formation station housing 50 (in which process cartridges 15 have been mounted) so that they can be rotated about the rotational axle 30*e* (support portion) located in the transfer frame 30. In this case, the rotational axle 30*e* is a means for moving the above-mentioned intermediary transfer belt unit 20 to expose the process cartridges 15 from behind the intermediary transfer belt unit 20.

Further, the above-mentioned rotational axle 30*e* is disposed so that its rotational axis is roughly parallel to the rotational axis of the photosensitive drum 10.

Further, the above-mentioned rotational axle 30*e* is located at one of the ends of the transfer frame 30 in terms of the direction in which the process cartridges 15 are aligned in the image formation station housing 50. In this embodiment, the image forming apparatus is structured so that the rotational axle 30*e* is located at the end of the transfer frame 30, which is located next to the process cartridge slot located farthest from the secondary transfer station. However, the image forming apparatus may be structured so that the rotational axle 30*e* is located at the end of the transfer frame 30, which is located next to the closest process cartridge slot to the secondary transfer station.

The intermediary transfer belt unit 20, which is rotatable about the rotational axle 30*e*, is provided with a pair of bearings 20*e*, by which the driver roller 21 is supported at its lengthwise ends. The bearings 20*e* constituting the pair are located at the free end of the intermediary transfer belt unit 20, and are inserted into the support holes 50*b* (different in position), one for one, with which the image formation station housing 50 is provided. Further, the transfer frame 30 is provided with a pair of positioning members 30*f* (FIGS. 4(*a*) and 4(*b*)), which are engaged, one for one, with a pair of support shafts 50*e* (FIG. 3(*b*)) with which the image formation station housing 50 is provided. With the employment of this structural arrangement, it is possible to form an image formation unit 60 (FIGS. 5(*a*) and 5(*b*)) in which the intermediary transfer belt unit 20 is accurately positioned relative to the image formation station housing 50, relative to which the process cartridges 15 are accurately positioned.

With the employment of the structural arrangement, which supports the process cartridges 15 and intermediary transfer belt unit 20 by the image formation station housing 50, the intermediary transfer belt unit 20 can be positioned relative to the photosensitive drums 10 at an extremely high level of accuracy, making it possible to produce excellent images, more specifically, images which do not suffer from positional deviation.

Further, the above-mentioned image formation station housing 50 supports so that the intermediary transfer belt unit 20 can be rotationally moved to expose the process cartridges 15 mounted in the housing 50. With the employment of this structural feature, the image forming apparatus can be improved in terms of the operability regarding the replacement of the process cartridges 15 by a user, while ensuring that the intermediary transfer belt unit 20 is positioned relative to each of the photosensitive drums 10 at a high level of accuracy.

The process cartridges 15 are to be replaced in the following manner. That is, first, the above-mentioned image formation station housing 50 is pulled out of the image forming apparatus, and then, the intermediary transfer belt unit 20 is rotationally moved away from the process cartridges 15. Then, the process cartridges 15 are replaced. Therefore, it does not occur that toner scatters in the image forming apparatus when a process cartridge is or process cartridges are replaced. Therefore, the contamination of the interior of the image forming apparatus, and the formation of unsatisfactory images, which are attributable to the scattering of toner in the image forming apparatus, which occurs when a process cartridge or process cartridges are replaced, do not occur. In particular, the exposing apparatus 16 is positioned below the process cartridges 15 and is fixedly disposed in the main assembly of the image forming apparatus. Therefore, the formation of unsatisfactory images, the defects of which are attributable to the falling of toner, which occurs when cartridges are replaced, does not occur.

The image formation station housing 50 (image formation unit 60), by which the process cartridges 15 and intermediary transfer belt unit 20 are integrally supported, is retractable into the image forming apparatus 1 by being supported and guided by the pair of support rails 42. Support rails 42 are supported by angle bracket 40*a*. As the housing 50 is retracted, the driving force transmitting portion for transmitting driving force to the process cartridges 15 and intermediary transfer belt unit 20, which the housing 50 supports, engages with the driving portion, which is disposed in the main housing 41, to transmit the driving force to the above-mentioned driving force transmitting portion for transmitting driving force to the process cartridges 15 and intermediary transfer belt unit 20. More specifically, a first drum coupling 10*b*, shown in FIG. 5(*a*), for driving the photosensitive drum 10 of the process cartridge 15, engages with a second drum coupling 43*a*, shown in FIG. 5(*b*), disposed in the main housing 41 of the main assembly of the image forming apparatus 1 to drive the photosensitive drum 10. Further, a first development coupling 12*a* for driving the developing apparatus 12 of the process cartridge 15 engages with a second development coupling 43*b*, disposed in the main housing 41, to drive the developing apparatus 12. Further, a first driver roller coupling 21*a* of the intermediary transfer belt unit 20 engages with a second driver roller coupling 43*c*, disposed in the main housing 41, to drive the driving roller 21. Thus, as the driving portion 43 of the main assembly operates, a driving force can be transmitted to the process cartridges 15 and intermediary transfer belt unit 20, which are supported by the image formation station housing 50, through these couplings.

Incidentally, the image forming apparatus is structured so that four positioning pins 50*e* (different in position), shown in FIG. 5(*a*), with which the image formation station housing 50 is provided, fit into the positioning holes 41*a*, with which the main housing 41 is provided.

Figures 6A, 6B:
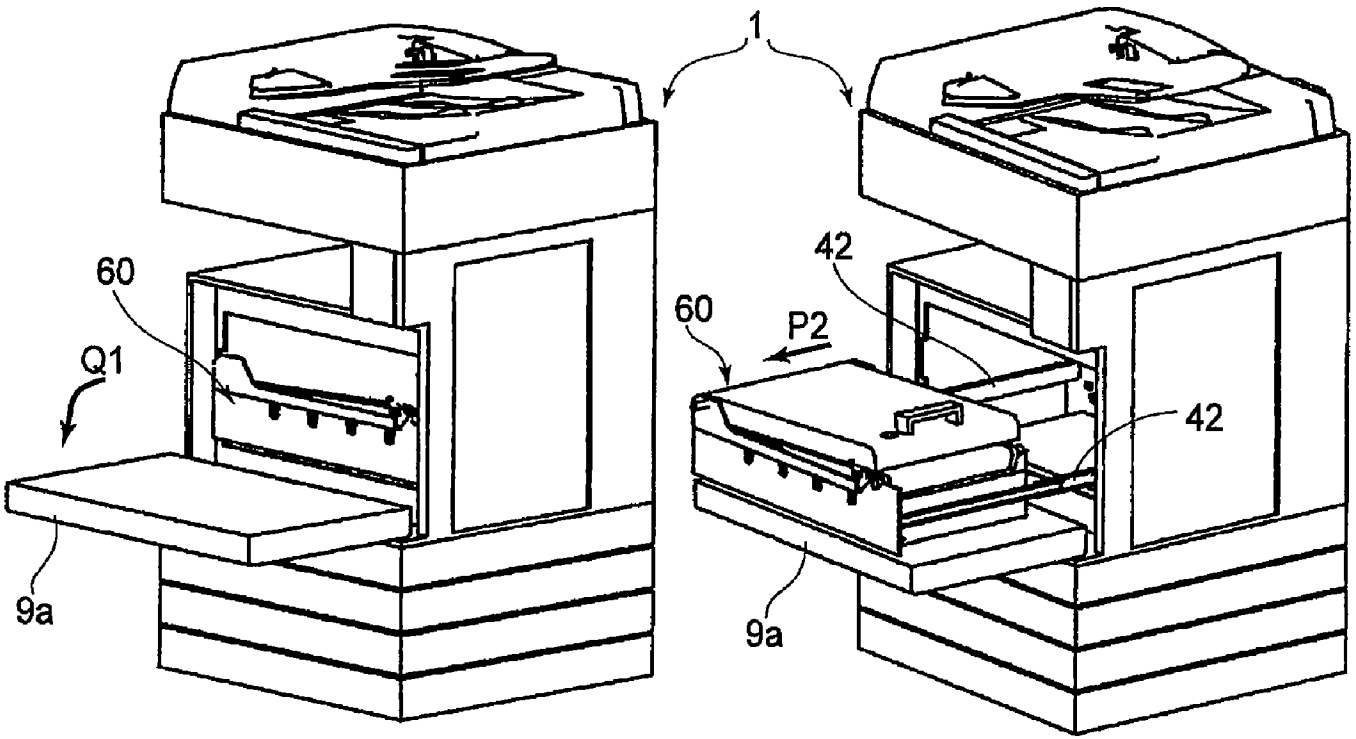
FIGS. 6(*a*) and 6(*b*) are drawings showing the method for replacing the process cartridges.

Next, referring to FIGS. 6(*a*), 6(*b*) and 7, the method for replacing the process cartridges 15 will be described. FIGS. 6(*a*), 6(*b*) and 7 are perspective views showing the flow of the operation for replacing the process cartridges 15.

Referring to FIG. 6(*a*), first, a front cover 9*a* of the image forming apparatus 1 is to be opened in the direction indicated by an arrow mark Q1. Next, the pressure being applied to the intermediary transfer belt 17 by the secondary transfer roller 5 is to be removed. For this pressure removal, the second transfer roller 5 is electrically or mechanically moved in the direction indicated by an arrow mark V1 in FIG. 1. As an example of the structural arrangement for electrically removing the pressure being applied by the secondary transfer roller 5, there is a structural arrangement that applies or removes the pressure from the secondary transfer roller 5 by turning on or off a solenoid switch. As a structural arrangement for mechanically removing the pressure being applied by the secondary transfer roller 5, there is a structural arrangement in which the pressure being applied by the second transfer roller 5 can be removed by rotating a lever, which supports the secondary transfer roller 5, so that the secondary transfer roller 5 can be pressed against, or moved away from, the driver roller 21 (intermediary transfer belt 17).

Figure 8:
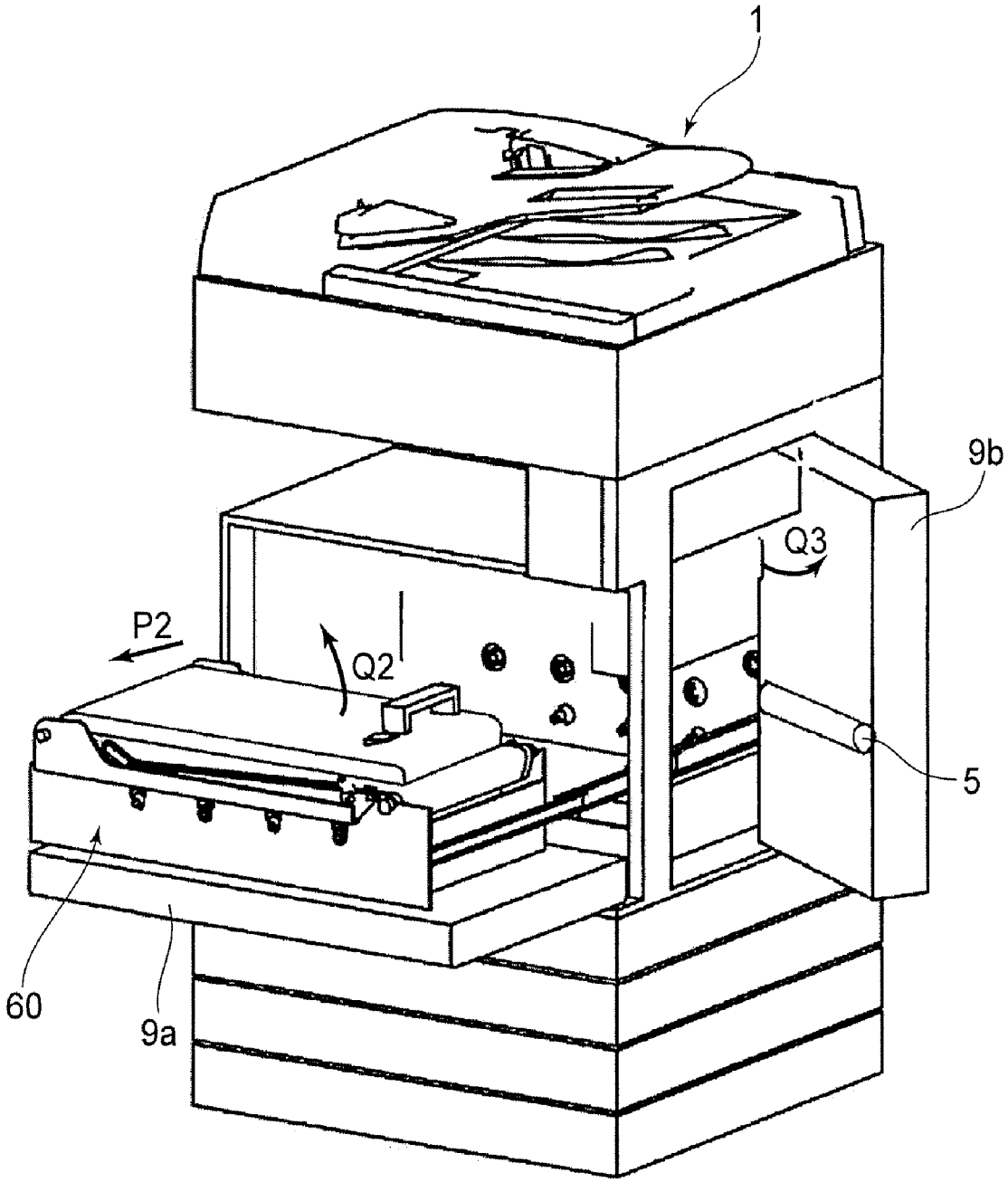
FIG. 8 is a drawing showing the method for replacing the process cartridges.

Incidentally, the structural arrangement for removing the pressure being applied to the intermediary transfer belt 17 by the secondary transfer roller 5 does not need to be limited to those described above. For example, the secondary transfer roller 5 may be supported by a conveyance door 9*b*, which can be opened or closed relative to the main assembly of the image forming apparatus 1, as shown in FIG. 8, so that the pressure being applied by the secondary transfer roller 5 can be removed by opening this conveyance door 9*b* in the direction indicated by an arrow mark Q3.

Next, the image formation unit 60 (integral assembly of transfer frame 30, intermediary transfer belt unit 20, process cartridges 15, and image formation station housing 50, which supports preceding components), is to be pulled out frontward of the main assembly, that is, in the direction indicated by an arrow marked P2, as shown in FIG. 6(*b*).

Figure 7:
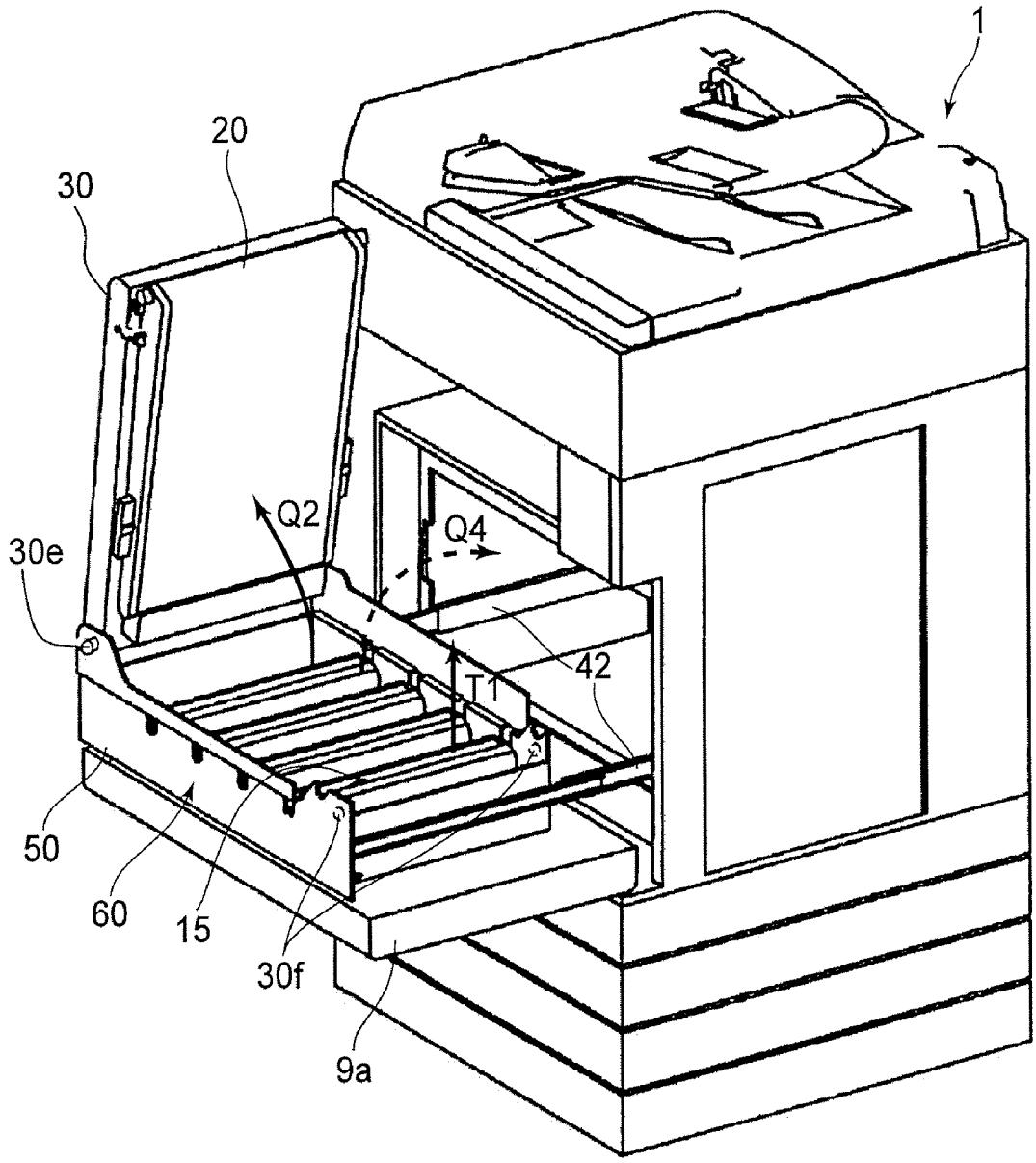
FIG. 7 is a drawing showing the method for replacing the process cartridges.

Next, referring to FIG. 7, the integral combination of the intermediary transfer belt unit 20 and transfer frame 30 is to be rotated about the rotational shaft 30*e* in the direction indicated by an arrow mark Q2, to cause the combination to be held upright by a holding means, such as a damper. By this operation, the process cartridges 15, mounted in the image formation station housing 50, are exposed from behind the intermediary transfer belt unit 20, making it possible to replace the process cartridges 15. In other words, the space necessary to mount or to remove the process cartridge 15 is provided. Thus, the process cartridges 15 can be pulled out upward (indicated by arrow mark T1) to be replaced.

In other words, the intermediary transfer belt unit 20 is rotated away from, or rotated to, the image formation station housing 50, after the image formation unit 60 is pulled out of the image forming apparatus. Therefore, it does not occur that the toner, which scatters as the intermediary transfer belt unit 20 is rotated, falls into the image forming apparatus. Further, the process cartridges 15 and intermediary transfer belt unit 20 are integrally held by the image formation station housing 50. Therefore, the level of accuracy, at which the photosensitive drums 10 are positioned relative to the intermediary transfer belt unit 20, is extremely high, and the amount by which toner scatters is extremely small.

In the case of the structural arrangement shown in FIGS. 6(*a*) to 8, the rotational shaft 30*e* of the transfer frame 30 is parallel to the axial lines of the photosensitive drums 10 in the process cartridges 15, and is located at the farthest end of the transfer frame 30 from the secondary transfer station. The structural arrangement for allowing the above-mentioned rotation of the intermediary transfer belt member 20 does not need to be limited to the above-mentioned one. For example, the above-mentioned rotational shaft 30*e* may be located at the other end of the transfer frame 30, that is, the end which is next to the secondary transfer station (position 30*f* indicated by dotted line in FIG. 7), so that the intermediary transfer belt unit 20 can be rotated about the thus positioned rotational shaft 30*e* in the direction indicated by an arrow mark Q4.

Figure 9:
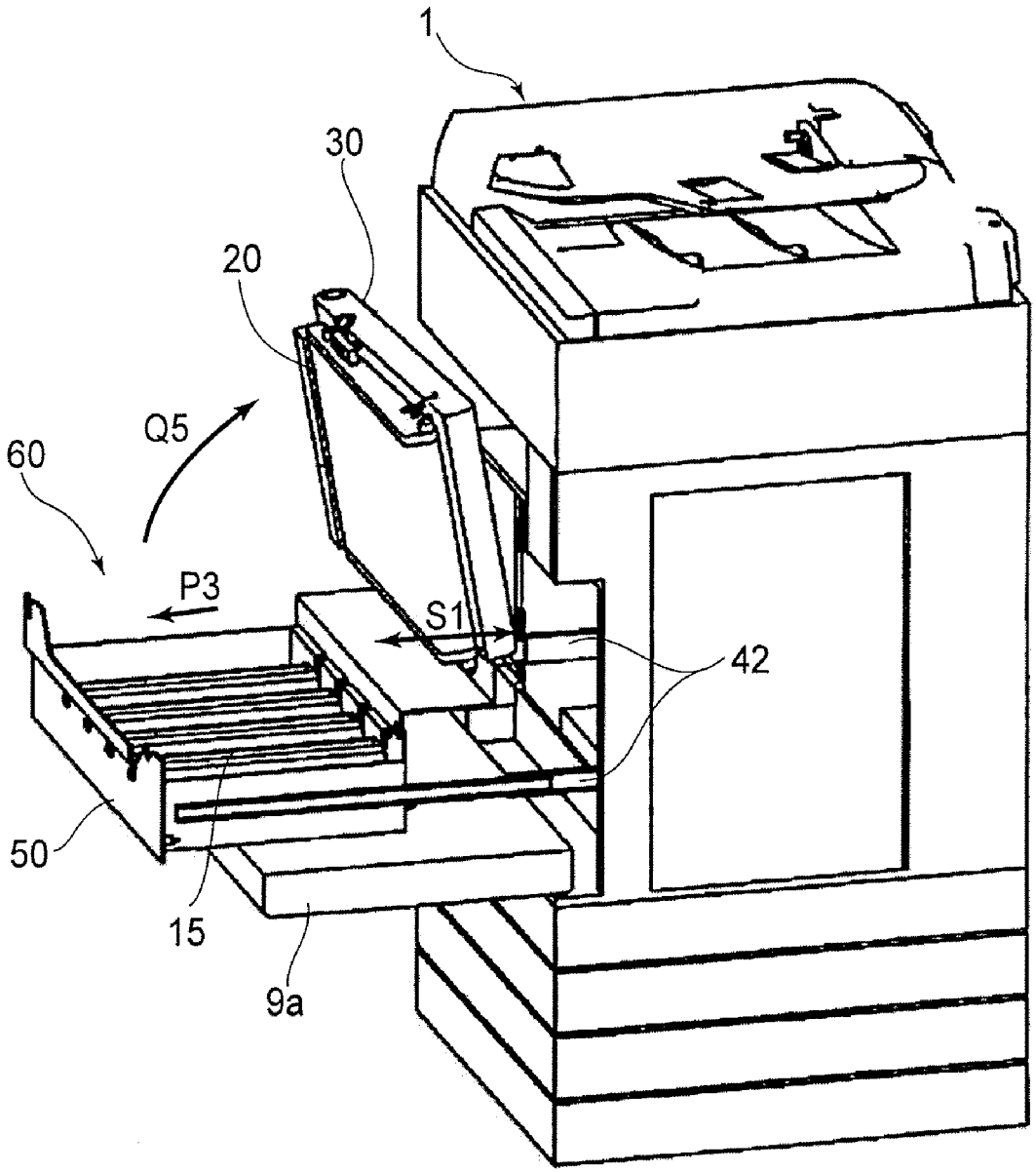
FIG. 9 is a drawing showing the method for replacing the process cartridges.

Further, in this embodiment, the rotational shaft 30*e* of the transfer frame 30 is parallel to the axial lines of the photosensitive drums 10 of the process cartridges 15. However, the rotational shaft 30*e* does not need to be parallel to the axial lines of the photosensitive drums 10. For example, a rotational shaft 30*e*, as a supporting portion, may be positioned so that its rotational axis is roughly perpendicular to the rotational axes of the photosensitive drums 10. More specifically, referring to FIG. 9, the rotational shaft 30*e* may be positioned at the back end of the transfer frame 30 in terms of the direction in which the image formation station housing 50 is moved relative to the main assembly, so that the intermediary transfer belt unit 20 can be rotated about the rotational shaft 30*e* in the direction indicated by an arrow mark Q5, or the rotational shaft 30*e* may be positioned at the front end of the transfer frame 301, in terms of the direction in which the image formation station housing 50 is moved relative to the main assembly, so that the intermediary transfer belt unit 20 can be rotated frontward about the rotational shaft 30*e*. In these cases, however, the amount by which the image formation unit 60 is pulled out of the image forming apparatus must be increased by S1, as compared to the setup shown in FIGS. 6(*a*) to 8. Also, as shown in FIG. 9, the image formation station housing 50 is to be pulled out frontward of the main assembly in the direction indicated by an arrow marked P3.

Figure 10:
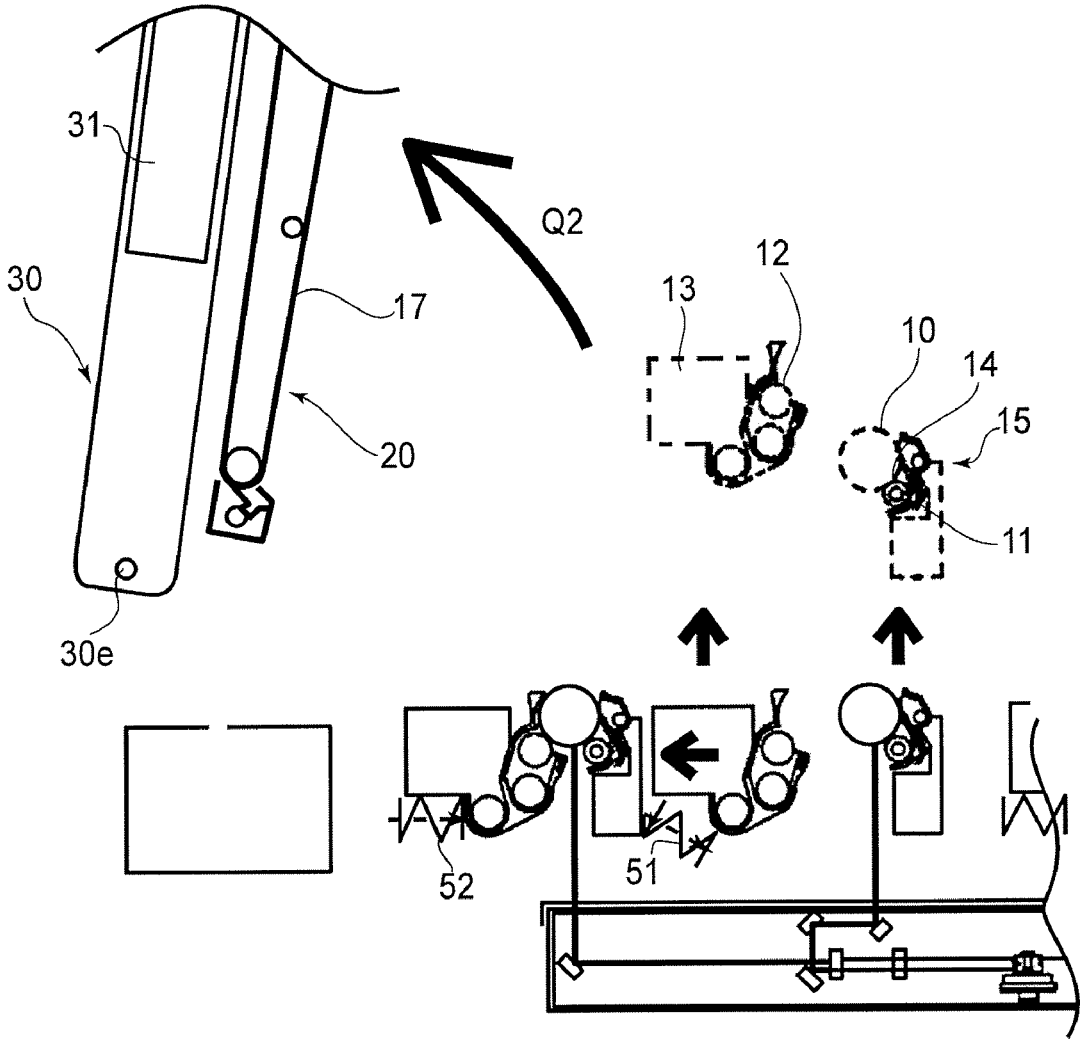
FIG. 10 is a drawing showing the method for replacing the process cartridges and developing apparatus.

Further, in the case of the embodiment described above, each of the process units was made up of a photosensitive drum and a developing apparatus, which are integrally combined. However, the makeup of the process unit does not need to be limited to that in this embodiment. For example, a developing apparatus 12, as a processing means which acts on the photosensitive drum 10, may be made to be a process unit, which is independent from the process cartridge 15 (process unit) inclusive of the photosensitive drum 10, and which is removably mountable in the image formation station housing 50, as shown in FIG. 10. In this case, when removing any of the process units (process cartridges 15 and developing apparatus 12) from the image formation station housing 50, first, the pressure applied by the pressure application springs 51 and 52, which are pressing each of the units 15 and 12, are to be removed, so that formation station housing 50, as shown in FIG. 10. In this case, when removing any of the process units (process cartridges 15 and developing apparatus 12) from the image formation station housing 50, first, the pressure applied by the pressure application springs 51 and 52, which are pressing each of the units 15 and 12, are to be removed, so that these process units may be removed from each of the units 15 and 12 can be individually replaced. This structural arrangement makes it possible to individually replace the process cartridges 15 and developing apparatus 12 according to their lives, this being extremely effective to reduce the operational cost of the image forming apparatus.

Further, the above-described embodiment exemplifies a structured arrangement in which the intermediary transfer belt unit 20 is supported by the transfer frame 30. However, the application of the present invention does not need to be limited to the above-described one. For example, even if no transfer frame is provided, effects similar to the above-described ones can be obtained by the employment of a structural arrangement in which the intermediary transfer belt unit 20 is provided with a rotational shaft (supporting portion) and the intermediary transfer belt unit 20 is rotatably attached to the image formation station housing 50.

In addition, the above-described embodiment exemplifies a structural arrangement in which the intermediary transfer belt unit 20 is rotationally moved away to allow the process cartridges to be replaced. However, the application of the present invention does not need to be limited to the above-described one. For example, in order to make it possible to replace process units, an image forming apparatus may be provided with a means for sliding the intermediary transfer belt unit 20 away from the image formation station housing 50. Further, an image forming apparatus may be structured so that process units can be moved, instead of the intermediary transfer belt unit, to allow the process units to be exposed from behind the intermediary transfer belt unit, in order to allow the process units to be replaced. In other words, all that is necessary is that an image forming apparatus is structured so that, after the image formation station housing is pulled out, the positional relationship between the intermediary transfer belt unit and process units can be changed, to create the space through which the process units can be mounted or removed.

Embodiment 2

Next, referring to FIGS. 11, 12(*a*) and 12(*b*), the image forming apparatus in the second embodiment of the present invention will be described. This embodiment exemplifies a structural arrangement in which the photosensitive drums 10 are not horizontally aligned, more specifically, they are aligned in such an inclined straight line L that the closer a photosensitive drum 10 is to the secondary transfer station, the lower in position is the photosensitive drum 10.

First, referring to FIG. 11, which is a sectional view of the image forming apparatus in the second embodiment of the present invention, the multiple process cartridges 15 are arranged in parallel or juxtaposed, and also, are aligned so that the farther a process cartridge 15 is from the secondary transfer station J, the higher in position the process cartridge than a process cartridge 15 located closer to the secondary transfer station J. Therefore, the process cartridge 15 having the photosensitive drum 10, which is closest to the secondary transfer station J, is positioned lowest, and the process cartridge 15 having the photosensitive drum 10, which is farthest from the secondary transfer station J, is highest, in position. Further, the intermediary transfer belt 17 is tilted downward toward the secondary transfer station, in parallel to the theoretical line connecting the center of the photosensitive drum 10 positioned highest and that of the photosensitive drum 10 positioned lowest.

Next, referring to FIGS. 12(*a*) and 12(*b*), the method for replacing the process cartridges 15 will be described. FIGS. 12(*a*) and 12(*b*) show the method for replacing the process cartridges 15.

Referring to FIG. 12(*a*), similar to the first embodiment, after the image formation unit 60 is pulled out frontward of the main assembly (in the direction indicated by arrow mark P2), the integrally combined intermediary transfer belt unit 20 and transfer frame 30 are rotationally moved about the rotational shaft 30*e*, in the direction indicated by an arrow mark Q6. With this operation, the process cartridges 15 are exposed from behind the intermediary transfer belt unit 20, being rendered replaceable. Thereafter, the process cartridges 15 can be taken out of the image formation station housing 50 in the direction indicated by an arrow mark T2 to be replaced.

Incidentally, referring to FIG. 12(*b*), in order reduce the size of the main assembly of the image forming apparatus in terms of the direction indicated by an arrow mark X, it is necessary to place two adjacent process cartridges 15 closer to each other. In this case, if an attempt is made to take a process cartridge 15 out of the image formation station housing 50 in the vertical direction (direction indicated by arrow mark T1), the process cartridge 15 collides with the adjacent process cartridge on the upstream side (portion K in FIGS. 12(*a*) and 12(*b*)). Therefore, such a structural arrangement is adopted in order for the process cartridges 15 to be moved out in the direction indicated by the arrow mark T2, which is roughly perpendicular to the theoretical line which connects the center lines of four photosensitive drums 10.

In this case, it is desired that the rotational shaft 30*e* be positioned at the end of the transfer frame 30, which is next to the farthest cartridge 15 from the secondary transfer station J, as shown in FIG. 12(*b*). The employment of this structural arrangement prevents the intermediary transfer belt unit 20 from interfering when taking the process cartridges 15 out of the image formation station housing 50 in the direction indicated by the arrow mark T2, drastically improving the image forming apparatus in terms of the replaceability of the process cartridges 15.

Incidentally, regarding the structural arrangement in which multiple process cartridges are aligned in parallel in the above-described inclined straight line, the position of the rotational shaft 30*e* does not need to be limited to the end of the transfer frame 30, which is next to the farthest process cartridge 15 from the secondary transfer station J, shown in FIGS. 12(*a*) and 12(*b*). All that is necessary is to position the rotational shaft 30*e* at the end of the transfer frame 30, which is next to the process cartridge 15, which is positioned highest among the process cartridges aligned in the inclined straight line.

For example, an image forming apparatus, in which multiple process cartridges are aligned in parallel in such an inclined straight line that the farthest process cartridge form the secondary transfer station is positioned lower than the closest process cartridge to the secondary transfer station, is feasible. In this case, it is desired that the above-mentioned rotational shaft be positioned at the end of the transfer frame, which is next to the closest process cartridge to the above-mentioned secondary transfer station.

Miscellaneous Embodiments

Figure 13A:
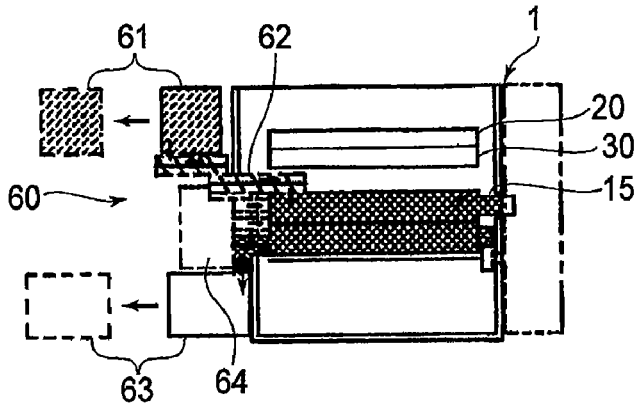
FIGS. 13(*a*) to 13(*c*), 14(*a*), and 14(*b*) are drawings showing the method for replacing the replenishment toner cartridges, waste toner recovering apparatuses, and process cartridges, which can be replenished with toner, and from which waste toner can be removed.
Figure 13B:
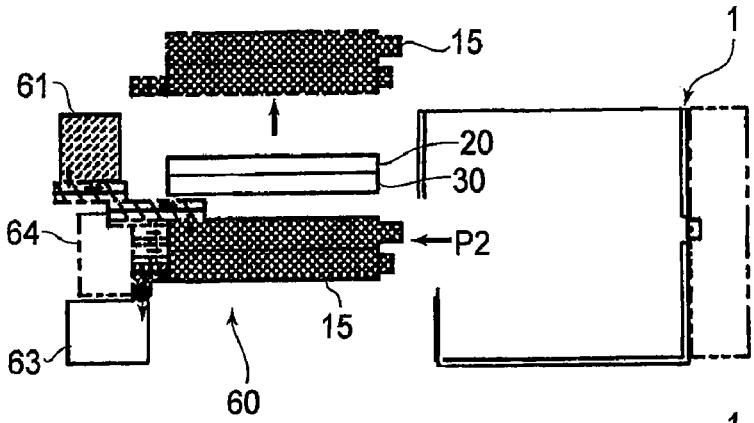
Figure 13C:
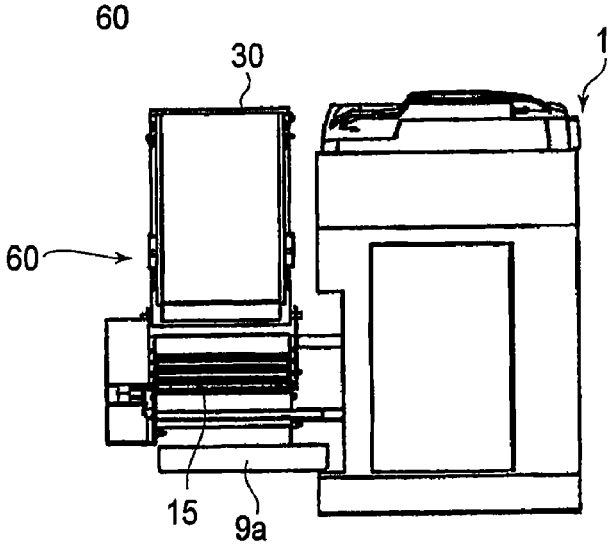
Figure 14A:
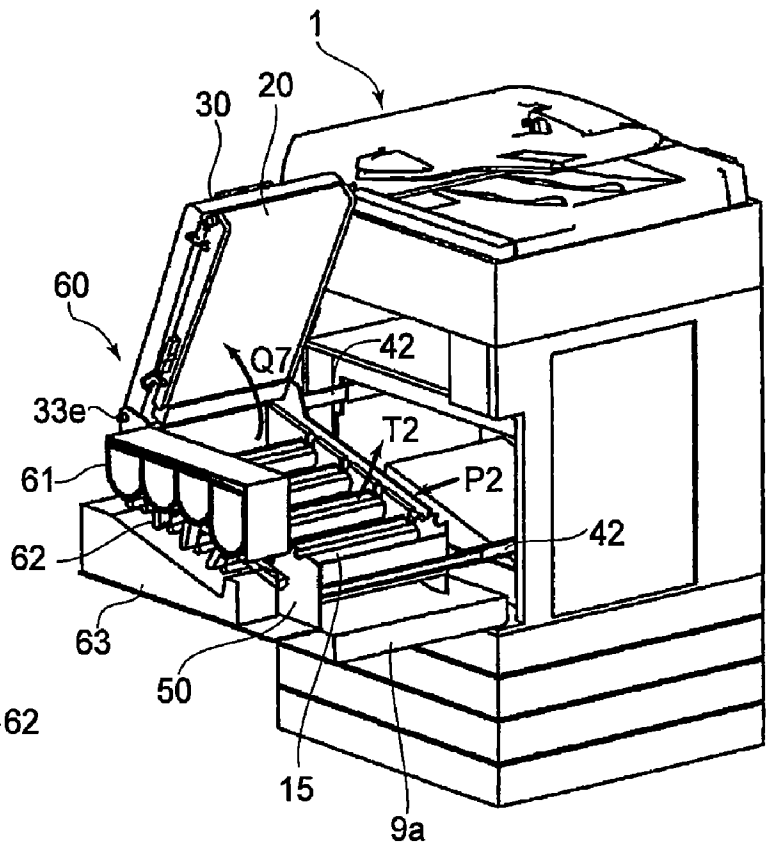
Figure 14B:
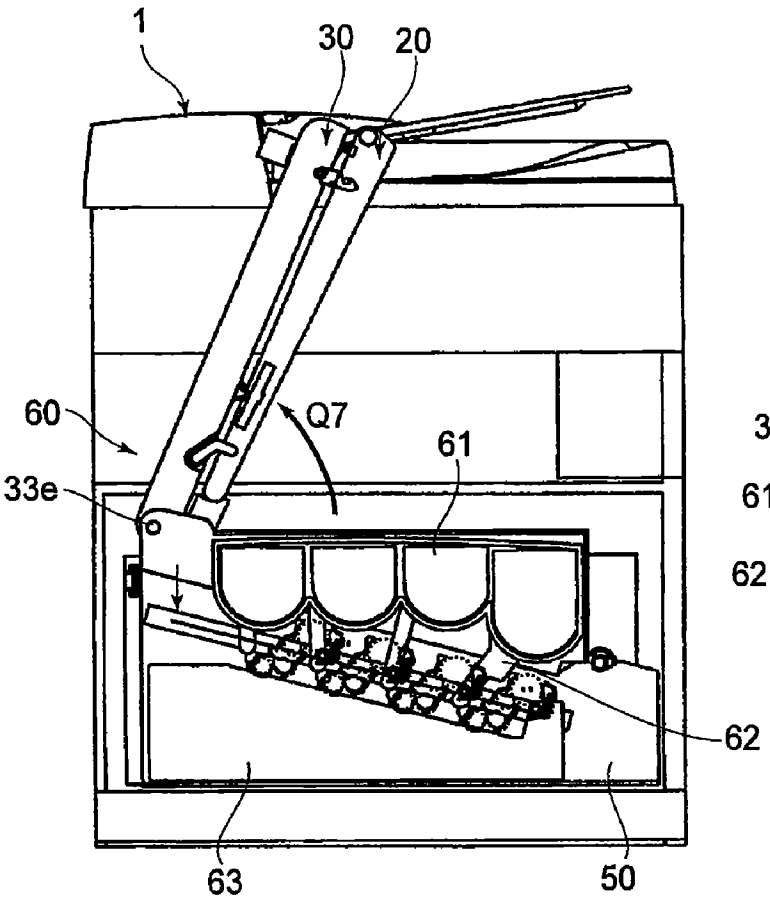

The above-described embodiments exemplify a structural arrangement in which each process cartridge 15 integrally comprises the toner storage portion (developer supplying means) for supplying toner, and the waste toner storage portion (developer recording means). However, the application of the present invention is not limited to this arrangement. For example, the developer supplying means for supplying developer or the developer recovering means for recovering developer may be rendered independent from the process cartridges and be removably mountable in the image formation station housing, as shown in FIGS. 13(*a*) to 4(*b*). Next, this structural arrangement will be described.

First, referring to FIG. 13(*a*), which is a sectional view of the right-hand side of the main assembly, the image formation unit 60 is present. This image formation unit 60 includes a process cartridge 15 removably mountable in the image formation unit 60, a developer supplying means independent from the process cartridge 15, and a developer recovering means independent from the process cartridge 15. The transfer frame 30 integrally combined with the intermediary transfer belt unit 20 is supported so that it can be rotated, much like a hinged door. Further, the image formation unit 60 includes a replenishment toner cartridge 61 as the developer supplying means, which is removably mountable. The toner in the replenishment toner cartridge 61 is supplied to the developing apparatus in the process cartridge by a toner supplying apparatus 62. Further, the image formation unit 60 includes a waste toner recovering apparatus 63 as the developer recovering means, which is removably mountable. Referring to FIGS. 13(*a*) to 13(*c*), designated by a referential symbol 64 is a high voltage apparatus for providing the process cartridges with a high voltage for a development process and a charging process. The high voltage apparatus 64 is contained in the image formation unit 60. The replenishment toner cartridge 61 and waste toner recovering apparatus 63 are removably mounted on the front portion of the image formation unit 60 (image formation station housing), which can be pulled out in the direction indicated by the arrow mark P2. Therefore, the replenishment toner cartridge 61 and waste toner recovering apparatus 63 can be individually replaced according to their service life, while the image formation unit 60 remains retracted in the main assembly of the image forming apparatus.

Next, referring to FIGS. 13(*b*) and 13(*c*), when it is necessary to replace any of the process cartridges 15, first, the image formation unit 60 is to be pulled out frontward of the main assembly (direction indicated by arrow mark P2). Then, the joined intermediary transfer belt unit 20 and transfer frame 30 are to be rotated in the direction indicated by an arrow mark Q7 to expose the process cartridges 15. Then, the process cartridges 15 can be pulled out in the direction indicated by the arrow mark T2 to be replaced.

In the case of a structural arrangement, such as the above-described one in which the process cartridges 15, replenishment toner cartridges 61, and waste toner recovering apparatuses 63 are individually replaceable, toner is transferred among the units.

In the embodiments described above, the replenishment toner cartridges 61, process cartridges 15, and waste toner recovering apparatuses 63 are removably supported by the image formation station housing 50, being thereby ensured in terms of the accuracy in their positional relationship among the units. Therefore, the scattering of toner rarely occurs when any of the units is replaced or toner is conveyed. Further, the process cartridges 15 are replaced after the replenishment toner cartridges 61 and waste toner recovering apparatus 63 are moved out of the main assembly of the image forming apparatus 1, along with the image formation unit 60. Therefore, the scattering of toner, in the image forming apparatus, which is attributable to the replacement of the process cartridges 15, and the formation of unsatisfactory images attributable to the scattering of toner, do not occur.

Incidentally, the embodiments described above exemplify a structural arrangement in which both the developer supplying means and developer recovering means are rendered removably mountable in the image formation station housing. However, the application of the present invention is not limited to this structural arrangement. For example, an image forming apparatus may be structured so that either the developing supplying means or developer recovering means is removably mountable in the image formation station housing.

Further, the measurements, materials, and shapes of the structural components, and their positional relationships, of the image forming apparatus described above, are not intended to limit the scope of the present invention, unless specifically noted.

While the invention has been described with reference to the preferred embodiments of the present invention disclosed herein, it is not confined to the embodiments described above, and this application is intended to cover such modifications or changes as may come within the purposes of the improvements or the scope of the following claims.

What is claimed is:

1. An image forming apparatus comprising:

an image forming unit including an image bearing member;

an intermediary transfer member onto which an image formed on said bearing member is transferred, said intermediary transfer member being disposed at an upper portion of said image forming unit;

a housing for supporting and accommodating said image forming unit and said intermediary transfer member, said housing being drawable from the image forming apparatus with said image forming unit and said intermediary transfer member supported thereby;

a supporting portion for supporting said intermediary transfer member for rotation relative to said housing; and a mounting and demounting portion, provided in said housing, for permitting said image forming unit to be mounted and demounted relative thereto, wherein mounting and dismounting of said image forming unit is enabled by rotating said intermediary transfer member, after said housing is pulled out of said image forming apparatus.

2. An apparatus according to claim 1, wherein said supporting portion is disposed such that an axis of rotation of said supporting portion is substantially parallel with an axis of rotation of said image bearing member.

3. An apparatus according to claim 1, wherein a plurality of such image forming units are juxtaposed, and wherein said supporting portion is disposed adjacent to an end one of said juxtaposed image forming units.

4. An apparatus according to claim 3, wherein said image forming units are arranged along a line inclined relative to a horizontal line, and wherein said supporting portion is disposed adjacent to a highest one of said image forming units.

5. An apparatus according to claim 3, wherein said image forming units are arranged along a line inclined relative to a horizontal line, and wherein a secondary transfer portion for transferring, onto a recording material, an image transferred onto said intermediary transfer member, is disposed adjacent to a lowest one of said image forming units, and said supporting portion is disposed adjacent to a remotest one of said image forming unit from said secondary transfer portion.

6. An apparatus according to claim 1, wherein an axis of rotation of said supporting portion is substantially perpendicular to an axis of rotation of said image bearing member.

7. An apparatus according to claim 6, wherein said supporting portion is disposed at a rear or front side of said housing with respect to a direction of drawing of said housing.

8. An apparatus according to claim 1, wherein said housing is drawable relative to a second housing supporting an entirety of a main assembly of said image forming apparatus.

9. An apparatus according to claim 8, wherein said housing is drawn out of said image forming apparatus while being supported on a rail member provided on said second housing.

10. An apparatus according to claim 1, wherein said housing integrally supports high voltage means for applying a high voltage to said intermediary transfer member for transferring the image.

11. An apparatus according to claim 1, wherein said housing integrally supports a detecting device for detecting an image density of the image transferred onto said intermediary transfer member or a color-misregistration in the image transferred onto said intermediary transfer member.

12. An apparatus according to claim 1, wherein said image forming unit integrally includes a developer supply device for supplying a developer or a developer collecting device for collecting the developer.

13. An apparatus according to claim 1, wherein a developer supply device for supplying a developer or a developer collecting device for collecting the developer is detachably mountable to said housing.

14. An apparatus according to claim 1, further comprising an exposure device for exposing said image bearing member to light, which is disposed in a lower portion of said image forming unit and is fixed in said image forming apparatus.

15. An apparatus according to claim 1, further comprising a developer device for supplying a developer to said image bearing member, which is not integral with said image forming unit, and wherein said image forming unit having said image bearing member and said developing device are detachably mountable to said housing, respectively.

* * * * *